United States Patent [19]

Scheerhorn

[11] Patent Number: 5,056,876

[45] **Date of Patent: * Oct. 15, 1991**

[54] DRAWER LOCK AND INTERLOCK MECHANISM

[75] Inventor: Douglas Scheerhorn, Byron Center, Mich.

[73] Assignee: Steelcase Inc., Grand Rapids, Mich.

[ * ] Notice: The portion of the term of this patent subsequent to Oct. 2, 2007 has been disclaimed.

[21] Appl. No.: 564,389

[22] Filed: Aug. 8, 1990

Related U.S. Application Data

[63] Continuation of Ser. No. 277,569, Nov. 29, 1988, Pat. No. 4,960,309.

[51] Int. Cl.[5] ..... E05C 7/06

[52] U.S. Cl. ..... 312/221

[58] Field of Search ..... 312/216-221

[56] References Cited

U.S. PATENT DOCUMENTS

| | | |
|---|---|---|
| Re. 26,902 | 5/1970 | Levenberg . |
| 108,874 | 11/1870 | Brown et al. . |
| 497,406 | 5/1893 | Du Bois et al. . |
| 970,933 | 9/1910 | Leese . |
| 2,240,067 | 4/1941 | Bolesky et al. . |
| 2,729,498 | 1/1956 | Law . |
| 2,829,021 | 2/1958 | Wolters . |
| 2,886,392 | 5/1959 | Stegmaier . |
| 3,188,160 | 8/1965 | Cornelius et al. . |
| 3,199,937 | 8/1965 | Mitchell . |
| 3,323,849 | 5/1967 | Stark . |
| 3,371,974 | 3/1968 | Vermeersch . |
| 3,378,321 | 9/1968 | Frederick et al. . |
| 3,404,929 | 10/1968 | Wright et al. . |
| 3,602,564 | 8/1971 | Lewin . |
| 3,622,216 | 11/1971 | Haunost . |
| 3,799,638 | 3/1974 | Faiks . |
| 3,866,993 | 2/1975 | Dean et al. . |
| 3,870,387 | 3/1975 | Mortashed . |
| 3,900,236 | 8/1975 | Goulish et al. . |
| 3,909,090 | 9/1975 | Breckner et al. . |
| 3,941,441 | 3/1976 | Scheerhorn . |
| 3,969,008 | 7/1976 | Pergler . |
| 4,077,684 | 3/1978 | Scherrer . |
| 4,108,516 | 8/1978 | Scholl . |
| 4,209,211 | 6/1980 | Alford . |
| 4,272,138 | 6/1981 | Stark . |
| 4,298,236 | 7/1981 | Laroche . |
| 4,303,287 | 12/1981 | Taplin . |
| 4,355,851 | 10/1982 | Slusser . |
| 4,429,930 | 2/1984 | Blouin . |
| 4,441,767 | 4/1984 | Stark . |
| 4,447,098 | 5/1984 | Parker . |
| 4,452,498 | 2/1984 | Wood, Jr. et al. . |
| 4,468,068 | 8/1984 | Kokubo et al. . |
| 4,480,883 | 11/1984 | Young . |
| 4,527,845 | 11/1985 | Kokubo et al. . |
| 4,637,667 | 1/1987 | Reid et al. . |
| 4,711,505 | 12/1987 | Lakso . |
| 4,732,434 | 3/1988 | Hartrum . |
| 4,768,844 | 9/1988 | Ludwig . |
| 4,770,476 | 9/1988 | Lakso . |
| 4,772,078 | 9/1988 | Bowyer ..... 312/221 |
| 4,960,309 | 10/1990 | Scheerhorn ..... 312/221 |
| 4,975,334 | 9/1990 | Lakso ..... 312/221 |

FOREIGN PATENT DOCUMENTS

| | | |
|---|---|---|
| 71248 | 2/1942 | Czechoslovakia . |
| 186677 | 4/1937 | Switzerland . |

*Primary Examiner*—Joseph Falk

*Attorney, Agent, or Firm*—Price, Heneveld, Cooper, DeWitt & Litton

[57] ABSTRACT

A lock and interlock mechanism for file cabinets, desks, storage units and the like includes an elongated channel which receives a plurality of elongated lock bars in a vertically stacked relationship. A plurality of cam actuators are selectively positionable adjacent the elongated channel. Each actuator is pivotally mounted for movement from a first to a second position upon opening movement of a cabinet drawer. The actuators each define cam portions adapted to engage one of the lock bars and shift it vertically. When one of the actuators is in the second or operative position, the remaining actuators may not be moved or are blocked from movement to their second positions. A detent arrangement on the actuator and lock bars holds each actuator in its second position in a detent type fashion. A control member is mountable on a drawer or drawer guide mechanism to pivot the actuator between its first and second positions. A lock includes a bar and wedge movable into the channel to prevent movement of the lock bars. This prevents opening of all of the drawers.

11 Claims, 7 Drawing Sheets

DRAWER LOCK AND INTERLOCK MECHANISM

This is a continuation of application Ser. No. 07/277,569, filed Nov. 29, 1988 now U.S. Pat. No. 4,960,309.

BACKGROUND OF THE INVENTION

The present invention relates to filling cabinets, desks, storage units and the like and more particularly to a combined lock and interlock mechanism which prevents the opening of more than one drawer at a time.

Lateral and vertical filing cabinets are typically provided with an interlock mechanism. Such a mechanism prevents the opening of more than one drawer at a time. If not included, there is a danger that the cabinet will tip over and cause injury or damage. Examples of prior interlock mechanisms may be found in U.S. Pat. No. 3,969,008 entitled SAFETY LATCH AND DRAWER MOVEMENT SEQUENCING CONTROL ARRANGEMENT FOR FILE CABINETS and issued on July 13, 1976 to Pergler; U.S. Pat. No. 4,355,851 entitled DRAWER INTERLOCK SYSTEM and issued on Oct. 26, 1982 to Slusser; U.S. Pat. No. 4,429,930 entitled INTERLOCK FOR DRAWERS and issued on Feb. 7, 1984 to Blouin; U.S. Pat. No. 4,480,883 entitled ANTI-TIP LOCKING DEVICE and issued on Nov. 6, 1984 to Young; and U.S. Pat. No. 4,711,505 entitled LOCKING SYSTEM and issued on Dec. 8, 1987 to Lakso.

Prior interlock systems have taken many different forms. For example, one system used to prevent the simultaneous opening of drawers includes a ribbon or cable which is connected between the drawers and a support on the frame of the cabinet. The cable has a predetermined slack which is taken up when a drawer is fully extended. Other drawers cannot be opened until the open drawer is closed. Other systems employ a plurality of vertically stacked latch bars mounted on one side of the cabinet. The drawers are each provided with separate cam members. When one drawer is moved, its cam member engages a cam surface on a latch bar to displace the latch bar. The latch bars then prevent or resist movement of additional drawers. Still other arrangements employ a plurality of lock members or elements mounted within a channel positioned on a side of the cabinet for vertical movement. A pivotally mounted cam element and a ball or wedge are provided for each drawer of the cabinet. The cam elements are engaged by pins carried by the file drawers. The free vertical space in the channel supporting the lock elements is limited to the space required for the opening of one drawer. Rotation of a cam element shifts the ball and wedge and the lock elements to prevent opening of additional drawers.

A need exists for an interlock system which is readily adaptable to different file cabinet and drawer configurations, which employs standardized components and which may be easily assembled without the use of special tools. A need exists for a system which insures that an actuator is held in a positive manner in its operative position to eliminate unintentional shifting due to jarring and the like. Further, a need exists for an interlock mechanism which can also readily lock all drawers of a cabinet.

SUMMARY OF THE INVENTION

In accordance with the present invention, a unique lock and/or interlock system is provided which is readily adaptable to a wide variety of cabinet or drawer systems and whereby the aforementioned needs are fulfilled. Essentially, the interlock system includes an elongated member defining a main channel. A plurality of control members or lock bars are disposed within the main channel in a stacked relationship. Each of the lock bars defines a cam follower surface. A plurality of cam actuators are selectively positionable along the main channel in vertically spaced relationship. Each cam actuator includes a cam portion movable against the cam follower surface of one of the lock bars to move the lock bar vertically within the main channel. When one of the cam actuators is in such a position, further vertical movement of the remaining lock bars is prevented. As a result, the actuators prevent opening of any of the remaining drawers.

In narrower aspects of the invention, provision is made for retaining the cam actuator in its second or operative position interposed between two adjacent control bars in a detent type fashion. As disclosed, each of the lock bars defines a detent recess within which a detent projection on the actuator may be received. Also, provision is made for resiliently biasing the actuator to its second position. A control member is mounted on the drawer or on a drawer guide mechanism. Outward movement of the drawer shifts the control member into contact with a respective one of the cam actuators. Further movement shifts the actuator from its inoperative to its operative position.

It is also presently preferred that provision be made for locking the cabinet. In one form, an elongated rod having a lock member on one end thereof is mounted on the cabinet structure. Rotation of a lock shifts the rod outwardly toward the side of the cabinet. The lock member is then interposed in the main channel. Vertical movement of the lock bars is thereby prevented. As a result, none of the cam actuators may be moved to their second, operative positions with movement being blocked by the contiguous lock bars. The interlock of the present invention, due to its construction, can readily include the lock function.

DETAILED DESCRIPTION OF THE PREFERRED EMBODIMENT

Figure 1:
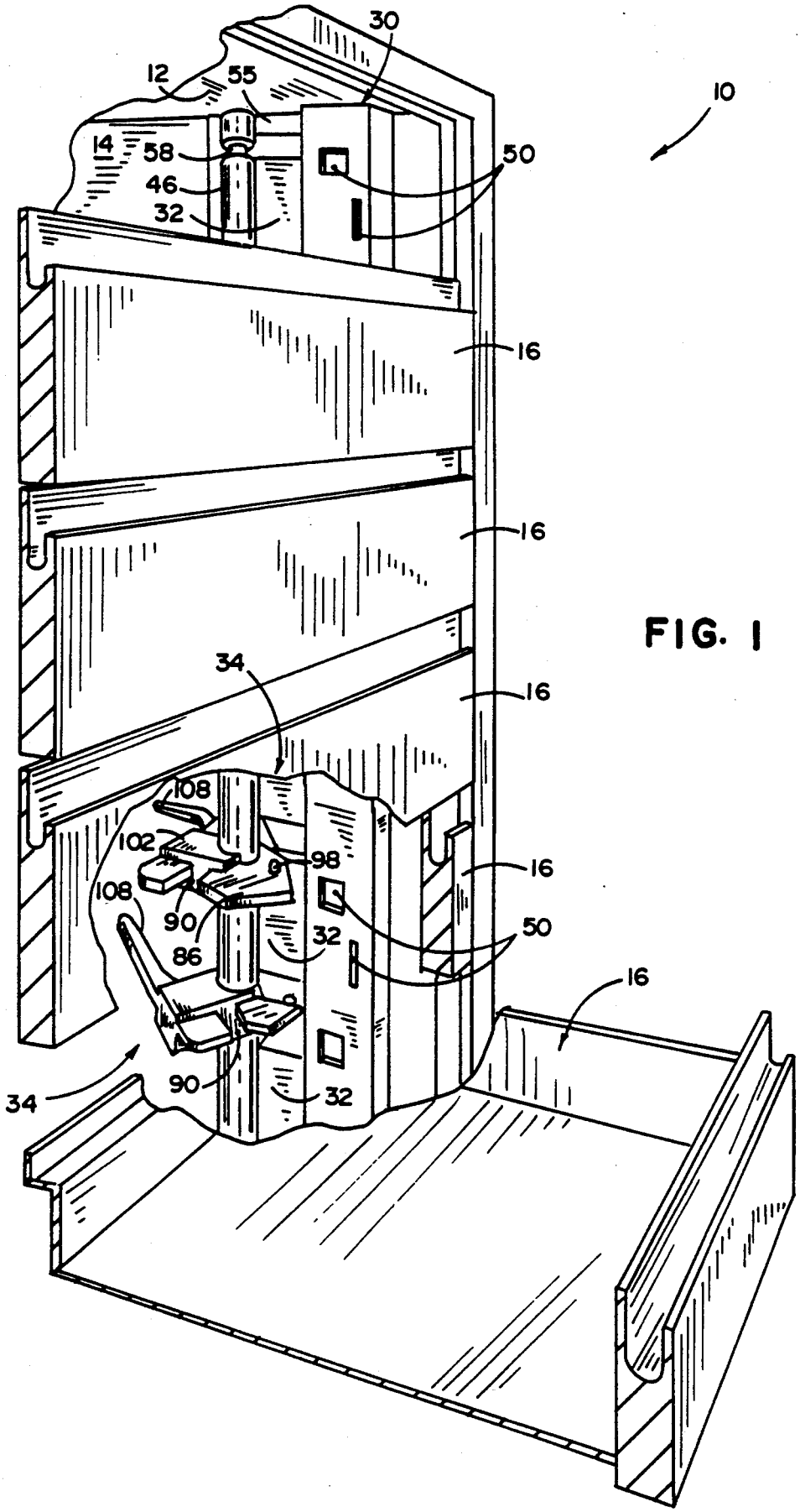
FIG. 1 is a fragmentary, front perspective view of a portion of a filing cabinet incorporating an interlock in accordance with the present invention.
Figures 2, 12, 13:
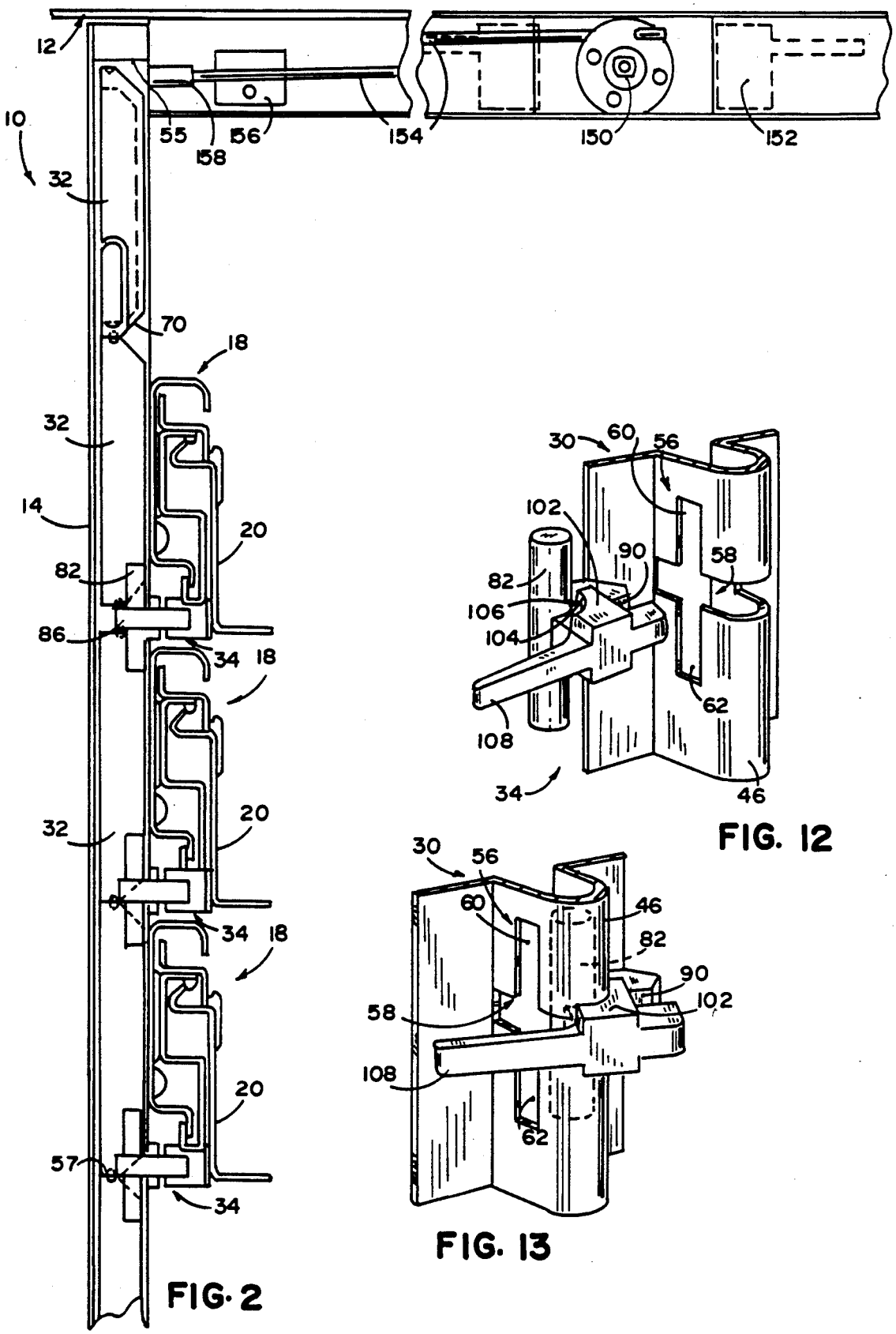
FIG. 2 is a front, fragmentary, elevational view of a portion of a filing cabinet incorporating the lock and interlock mechanism in accordance with the present invention.
FIG. 12 is a fragmentary, enlarged, perspective view showing the manner of positioning a cam actuator on a support channel.
FIG. 13 is a fragmentary, perspective view showing a cam actuator mounted on its support channel.
Figure 3:
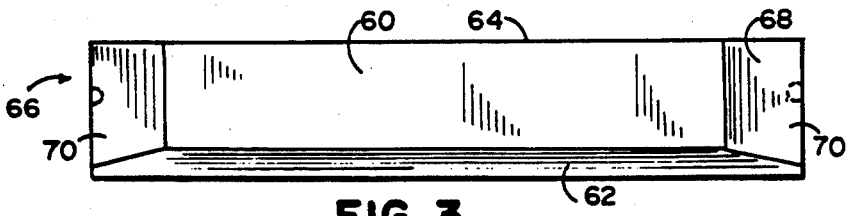
FIG. 3 is a front or top elevational view of a control bar in accordance with the present invention.
Figure 7:
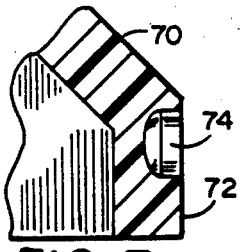
FIG. 7 is a cross-sectional view taken generally along line VII—VII of FIG. 6.
Figure 4:
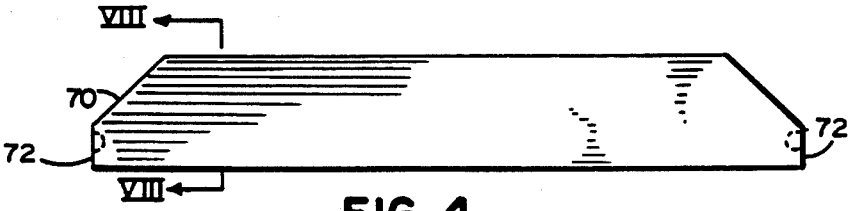
FIG. 4 is a side, elevational view of the control bar.
Figure 6:
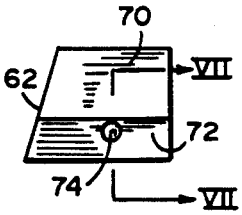
FIG. 6 is an end elevational view of the control bar.
Figure 5:
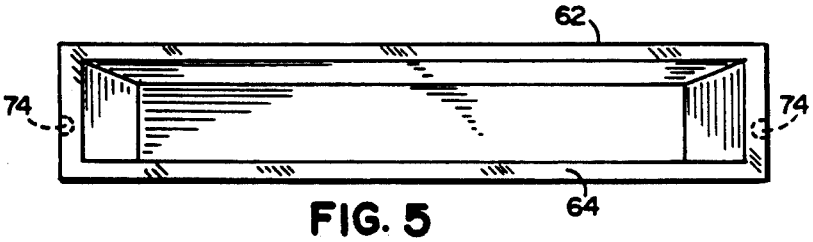
FIG. 5 is a bottom view of the control bar.
Figure 8:
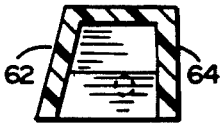
FIG. 8 is a cross-sectional view taken generally along line VIII—VIII of FIG. 4.

A filing cabinet or storage unit incorporating an interlock system in accordance with the present invention is illustrated in FIGS. 1 and 2 and generally designated by the numeral 10. Cabinet 10 includes a housing defined by a top 12 and sides 14. Supported within the housing are a plurality of superimposed, vertically arranged drawers 16. In FIG. 1, a lowermost drawer is illustrated in an open position. In a conventional fashion, as illustrated in FIG. 2, for example, individual drawers 16 may be mounted on or connected to drawer guide subassemblies 18. Drawer guides 18 are mounted directly to or suspended from sides 14 of the cabinet at vertically spaced positions. Drawers may be secured to L-shaped members 20.

Figure 14:
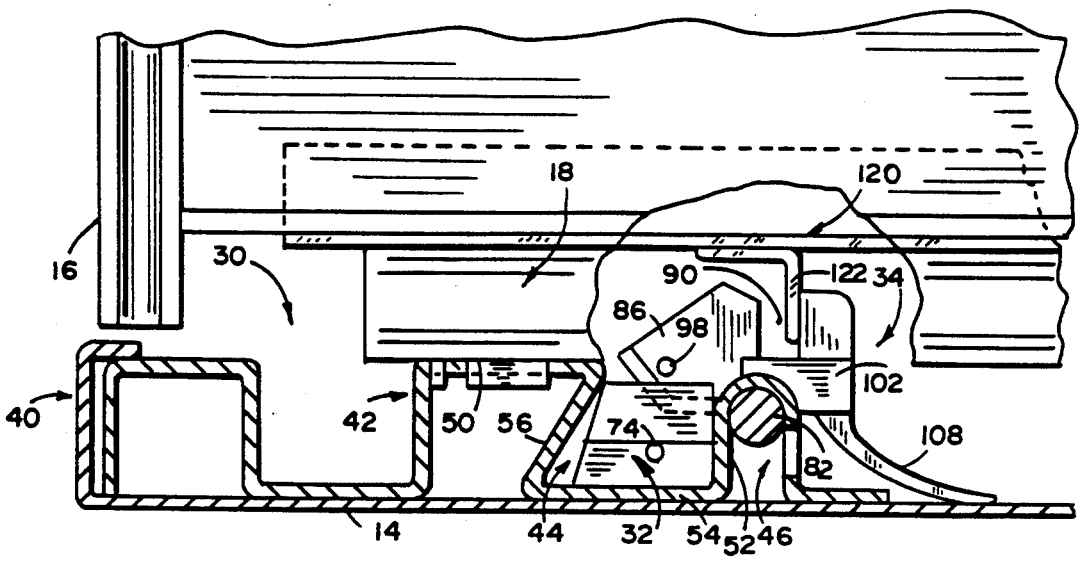
FIG. 14 is a fragmentary, cross-sectional view of a portion of the filing cabinet showing a drawer in a closed position.

As best seen in FIGS. 1, 2 and 14, the interlock system in accordance with the present invention includes an elongated member 30, a plurality of stacked control blocks or lock bars 32 and a plurality of cam actuators 34. As shown, member 30 is attached to side 14 of the storage unit. The interlock could be mounted or attached at the other points on the interior surface of the unit such as to the rear of the unit, depending upon space availability and other factors determined by the configuration of the unit.

Elongated member 30, as seen in FIG. 14, includes a forward box section 40, a drawer guide attachment section 42, a main channel or guide track 44 and a generally U-shaped hinge channel, actuator mounting channel or portion 46. Portion 42 defines a plurality of slots 50. Drawer guides 18 are suspended from the support member at slots 50. Main channel 44 has a modified dovetail configuration in cross section. Channel 44 is defined by a side 52, a base 54 which extends perpendicular to side 52 and an acutely angled side 56. Side 56 is angled towards side 52. The configuration of the channel retains lock bars 32 therein. The channel opens towards drawers 16. When positioned within the cabinet, channel 44 is closed at its ends 55, 57. Attachment channel 46 is generally U-shaped in cross section. As best seen in FIGS. 12 and 14, portion 46 defines a plurality of vertically spaced, generally cross-shaped slots 56. Each slot includes a main horizontally extending portion 58 and a pair of arms 60, 62. As explained in more detail below, slots 56 permit actuators 34 to be positioned selectively in vertically spaced relationship along elongated member 30.

Each control block 32, as seen in FIGS. 3–8, is an elongated, hollow member including a front face 60, an angled side 62, a side 64 which extends generally perpendicular to face 60 and beveled or angled ends 66, 68. Ends 66, 68 define inwardly angled cam follower surfaces 70 and flat portions 72. Each portion 72 defines a detent recess 74 opening therethrough. As seen in FIG. 14, for example, the cross-sectional shape of each guide block 32 is such that it conforms to the general cross-sectional configuration of main channel 44. Face 60 and cam follower surfaces 70 face outwardly through the front opening of channel 44 towards drawers 16.

Figure 9:
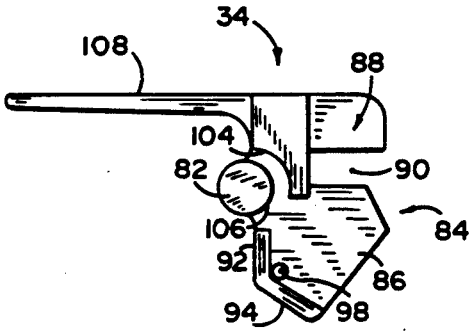
FIG. 9 is a top, plan view of a cam actuator included in the present invention.
Figure 10:
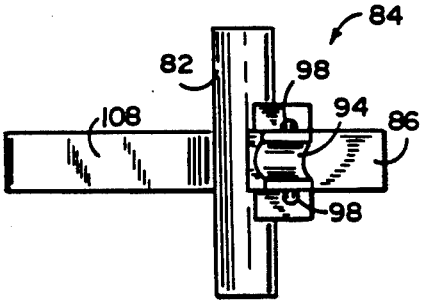
FIG. 10 is a front, elevational view of the actuator of FIG. 9.
Figure 11:
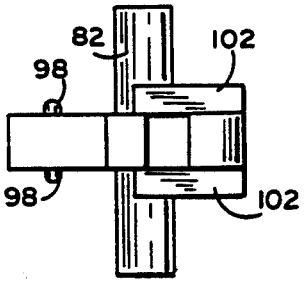
FIG. 11 is an end, elevational view of the actuator.

As seen in FIGS. 9, 10 and 11, each cam actuator 34 is preferably fabricated as a one-piece member from a suitable plastic material. Actuator 34 includes a vertically extending hinge or pivot pin 82 and an intermediate body portion 84. Body portion 84 defines a cam portion 86 and a control portion 88. Opening through control portion 88 is a control slot 90. Cam portion 86 includes angularly related, V-shaped wedge or beveled portions 92, 94.

Detent pins or projections 98 extend coaxially above and below cam portion 86 immediately adjacent the wedge or V-shaped portion 94. Mounting groove defining blocks 102 are formed in control portion 88 adjacent hinge point 82. Blocks 102 have a surface 104 facing pin 82 which conforms with the curvature of pin 82. Pin 82 and surface 104 define a mounting slot or groove 106. A resilient finger 108 extends parallel to control slot 90.

FIGS. 12 and 13 illustrate the manner by which an actuator 34 may be positioned along actuator support portion 46 at a slot 56. The vertical extension of arms 60, 62 of slot 56 corresponds to the vertical height of hinge pin 82. The width of portion 58 corresponds to the width or thickness of body 94 of actuator 34. As seen from FIGS. 12 and 13, the actuator may be positioned adjacent to portion 46. It may be turned so that pin 82 and body 84 along groove 106 may be inserted into slot 56. Pin 82 may then be positioned against the inner surface of groove 46, as seen, for example, in FIG. 14, and the portions of the elongated member adjacent slot portion 58 are rotated into groove 106. Channel portion 46 is, therefore, captured between pin portion 82 and blocks 102. Member 30 defines a plurality of slots 56. Actuators 34 are positionable at any of the slots to accommodate different types and sizes of drawers. The system is adaptable to many cabinets, desks or storage unit configurations. The mounting arrangement simplifies assembly. No tools are needed to mount the actuators.

Figure 15:
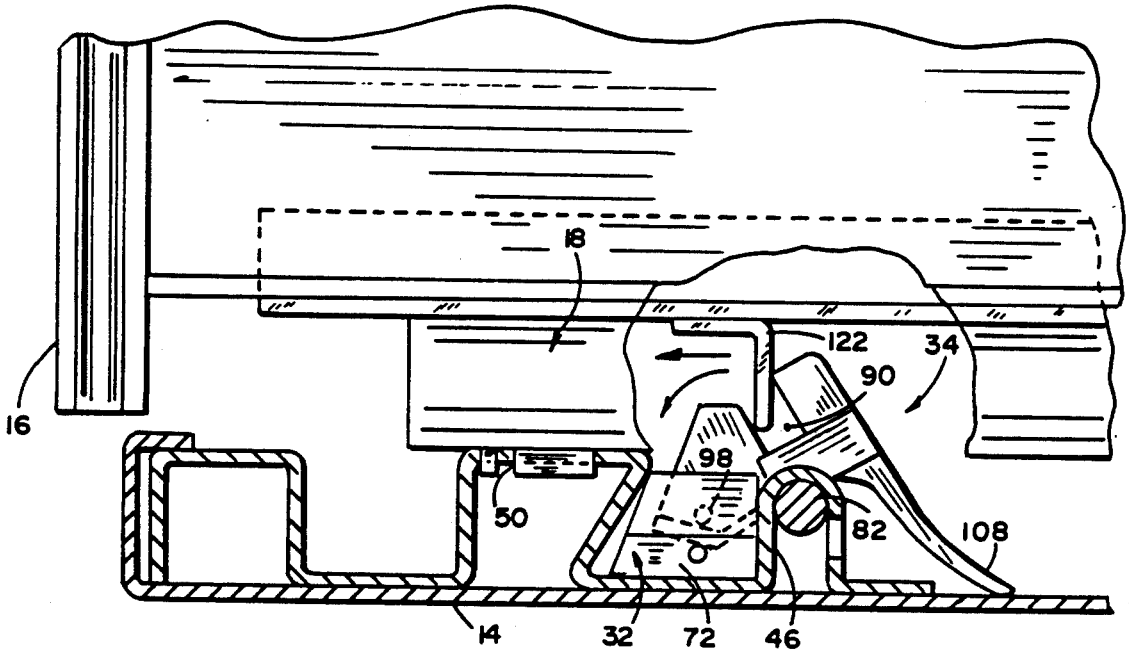
FIG. 15 is a cross-sectional view of the filing cabinet showing the drawer moving towards an open position.
Figure 16:
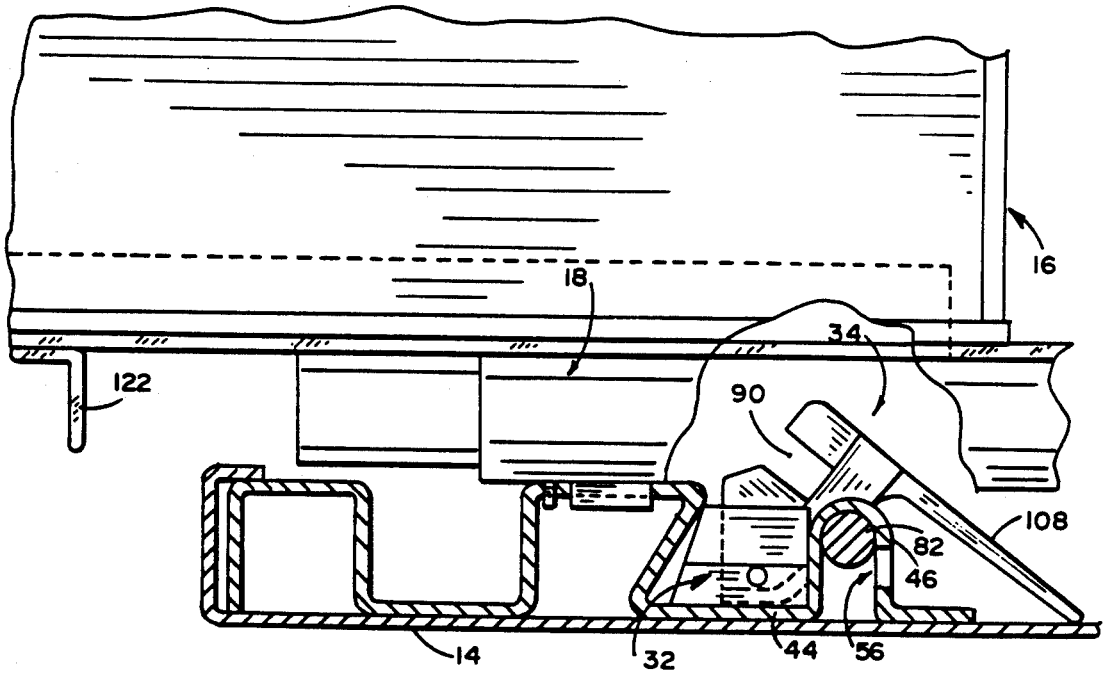
FIG. 16 is a fragmentary, cross-sectional view showing the drawer in a fully opened position.

As seen in FIG. 2, the vertical height dimension of main channel 44 is approximately equal to the vertical height dimension of the stacked control bars 32 plus the thickness of cam portion 86 of actuator 34. FIG. 14 illustrates an actuator 34 in its first or inoperative position with its respective drawer 16 in a closed position. A control means shown in the form of an L-shaped bracket 120 is secured to a side of a drawer 16. In the alternative, bracket 120 may be secured directly to the extensible drawer guide 18. Bracket 120 includes a leg 122 which extends into actuator slot 90. With the drawer in the closed position, resilient finger 108 abuts side 14 of the cabinet. Finger 108 holds pivot pin 82 secure against the inner surface of channel portion 46 and biases actuator 34 in a counterclockwise direction, as viewed in FIG. 14. As shown in FIGS. 15 and 16, as a drawer 16 is pulled forward towards its open position, control leg 122 moves and pivots actuator 34 in a counterclockwise direction. Linear movement of drawer 16 causes cam portion 86 to engage a cam follower surface 70 of an immediately adjacent control bar 32. The actuator is rotated until the cam portion is disposed between two adjacent control bars 32 in the stack. Beveled portions 92, 94 are angularly related so that cam portion 86 can rotate between adjacent bars through the limited opening of channel 44.

As shown in FIG. 2, bars 32 above actuator 34 associated with the drawer being opened, are moved upwardly within main channel 44. Due to the dimensional limitations of the channel, the uppermost bar will engage the upper closed end of the channel. As a result, no further vertical movement of the bars within the channel is permitted. Detent projections 98 on the actuator are received within detent recesses 74 at the opposed or facing ends 72 of adjacent control bars 32.

As shown in FIG. 2, any attempt to open any of the remaining drawers will not be successful. Should an adjacent drawer be moved towards an open position, its control bracket 120 will not be able to rotate its respective cam actuator 34. Such an actuator will move its cam portion 86 into contact with a cam follower surface of an adjacent lock bar. Since further vertical movement within main channel 44 is prevented, actuator 34 cannot rotate further and bracket 122 cannot move out of slot 90.

Resilient finger 108 biases actuator 34 from its first, inoperative position, as shown in FIG. 14, to its second, operative position, shown in FIG. 16. As shown in FIG. 16, when in the operating position, finger 108 is fully extended and holds the actuator in position. Finger 108 assures that pin 82 remains in its proper position against the inner surface of attachment channel 46. The resilient bias of finger 108 and the detent structure retains the actuator in its operative position against accidental dislodgment. Should an actuator move out from between the bars while a drawer is still open, operational problems would result. Due to the detent and finger, jarring, bumping and the like will not dislodge the actuator.

Figure 17:
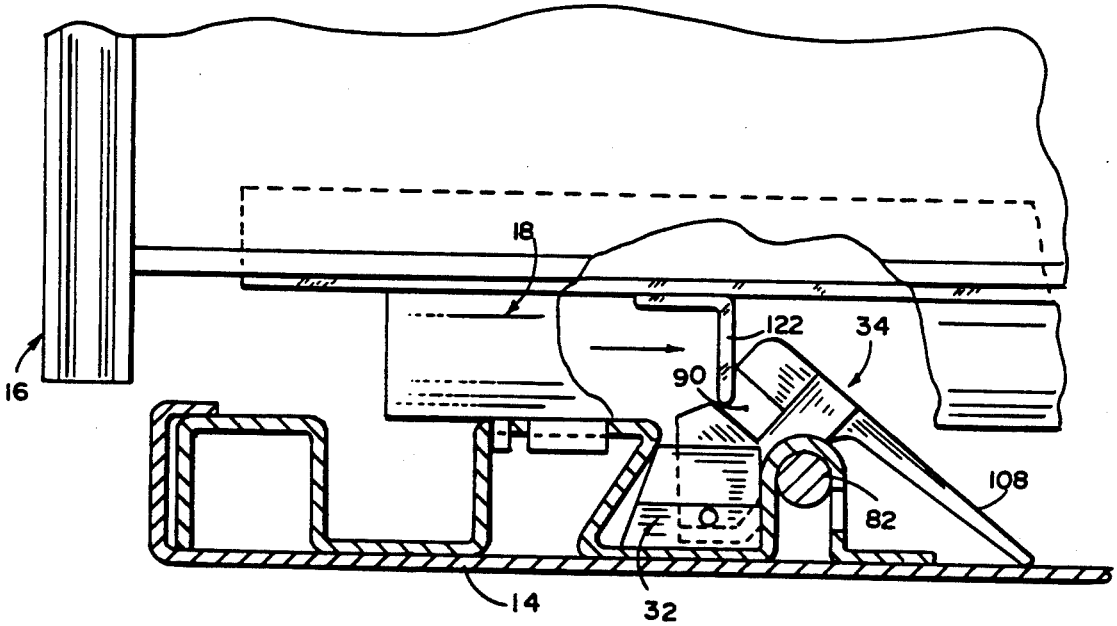
FIGS. 17, 18 and 19 are fragmentary, cross-sectional views of a filing cabinet showing a drawer moving from an opened to a closed position.
Figure 18:
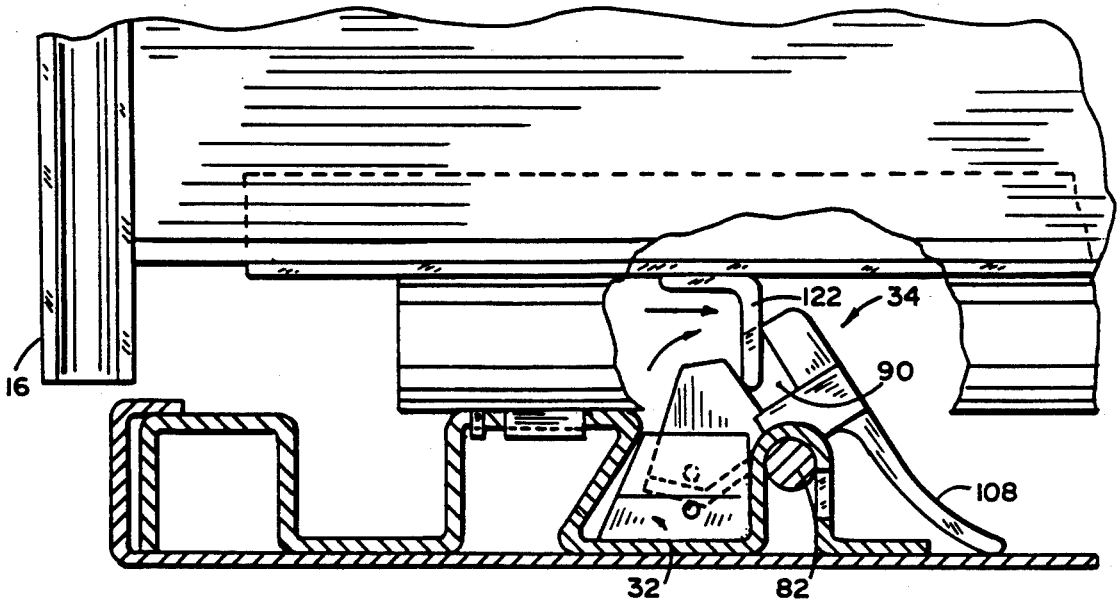
Figure 19:
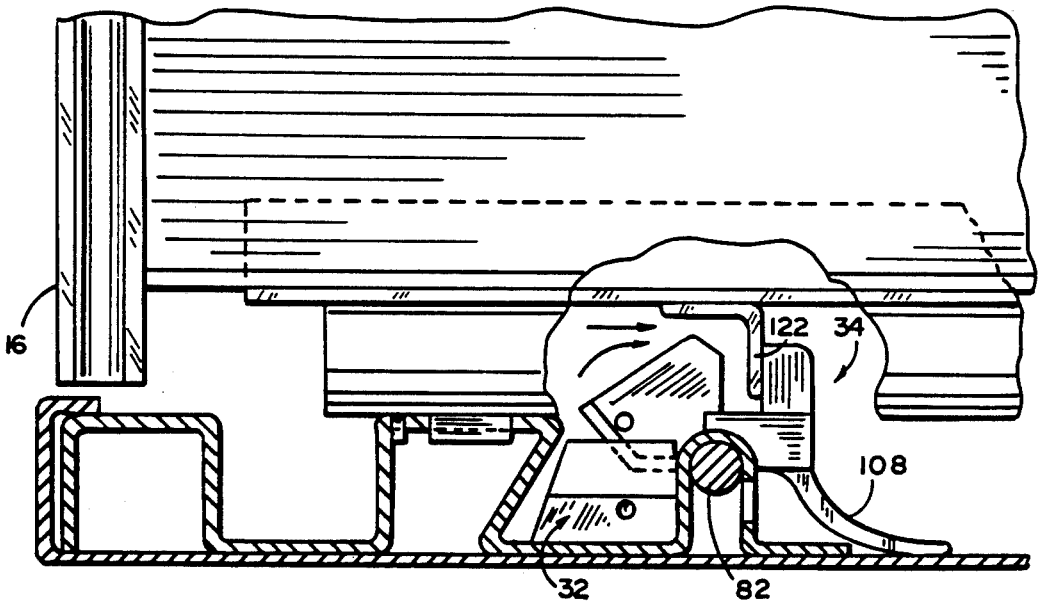

When the drawer is closed, as shown in FIGS. 17–19, bracket portion 122 enters the open end of slot 90 and engages the control arm portion of actuator 34. Further rearward or closing movement of the drawer pivots or rotates actuator 34. Detent projections 98 are ramped out of recesses 74. Actuator 34 is rotated until cam portion 86 has been completely removed from between opposed faces 72 of adjacent lock bars against the bias of finger or spring 108. Once removed, vertical movement within main channel 44 will now be permitted.

A lock, as shown in FIG. 2, is readily used with the interlock to provide a lock and interlock in a single mechanism. As shown, a conventional lock cylinder 150 may be mounted on cabinet 10 with the key slot extending through a front portion 152. A lock bar or rod 154 extends from cylinder 150 towards side 14 of cabinet 10. Lock bar 154 is supported in a suitable mounting bracket 156. A lock member 158 is secured to the end of bar 154. As should be apparent from FIG. 2, when all of the drawers are closed and lock cylinder 150 is rotated to shift lock bar 154 towards side 14, lock member 158 enters channel 44 and engages a cam follower surface 70 of the top most control bar 32. Member 158 closes off the channel and prevents vertical movement of the bars within the channel. As a result, the control members 120 associated with each drawer will be unable to pivot actuators 34 to their operative position between adjacent control bars. The lock system prevents locking of the drawers unless all are in their fully closed position. This prevents a user from inadvertently leaving one drawer partially open.

In lateral files having wide drawers, it is preferred that two lock and interlock mechanisms be used, one on each side of the cabinet. The lock mechanism would, therefore, include two rods and members extending towards the sides. The drawer will be locked at both ends for increased stability. If only a single lock/interlock is used, the drawers could be pulled out to some extent at the unlocked sides. In a unit with only a single drawer, channel 30, a single control bar 32, a single actuator 34, lock cylinder 150, rod 154 and member 156 can be used to lock the drawer.

The lock and interlock system in accordance with the present invention is readily added to or made a part of a cabinet, desk or storage unit having movable or openable members which can act on the cam actuators through a bracket or other control. Employing an elongated member which defines a plurality of spaced slots for attachment points of the individual actuators permits the actuators to be mounted at selectively different locations. The system is, therefore, readily adaptable to file cabinets or units having drawers of different vertical heights. The correct location along channel defining member 30 is determined and an actuator is easily positioned through a mounting slot 56. No tools are needed and assembly is simplified.

Only a single control or contact member 120 associated with each drawer or movable member is necessary to shift the cam actuators between their off and on positions. The detent mechanisms insure that the actuators are maintained in their proper position until the drawer is closed. Bouncing or jarring of the cabinet should not cause the actuator to move out from between adjacent control bars. Finger 108 also insures that the actuator will stay in its proper position. In order to move out from between the control bars, actuator 34 must move against the resilient bias of finger 108.

ALTERNATIVE EMBODIMENT

Figure 20:
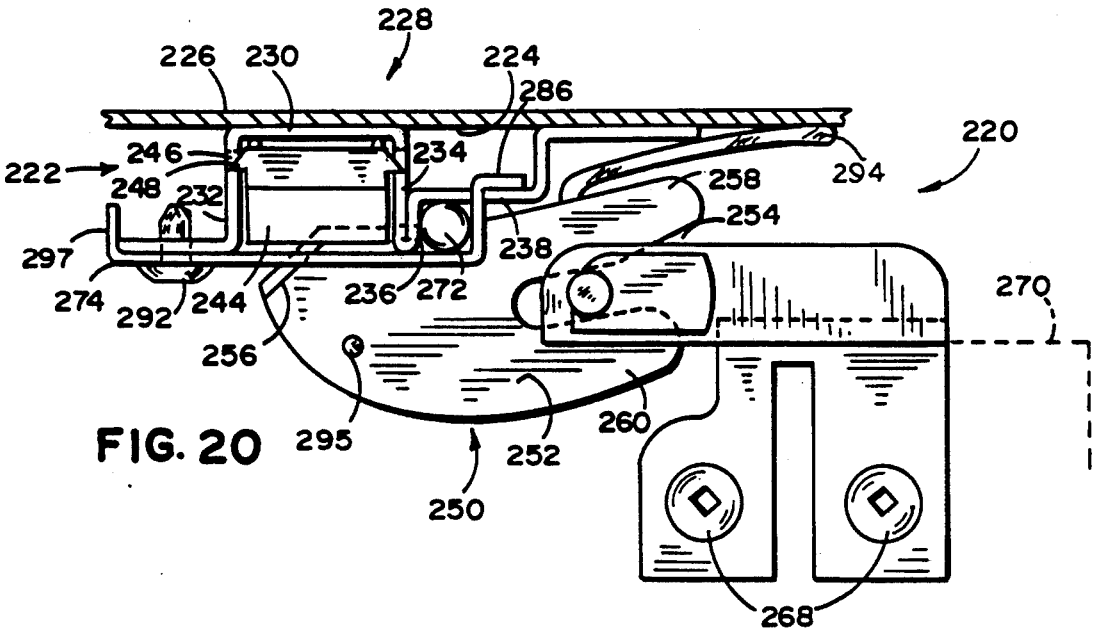
FIG. 20 is a fragmentary, cross-sectional view of an alternative embodiment of the present invention.
Figure 21:
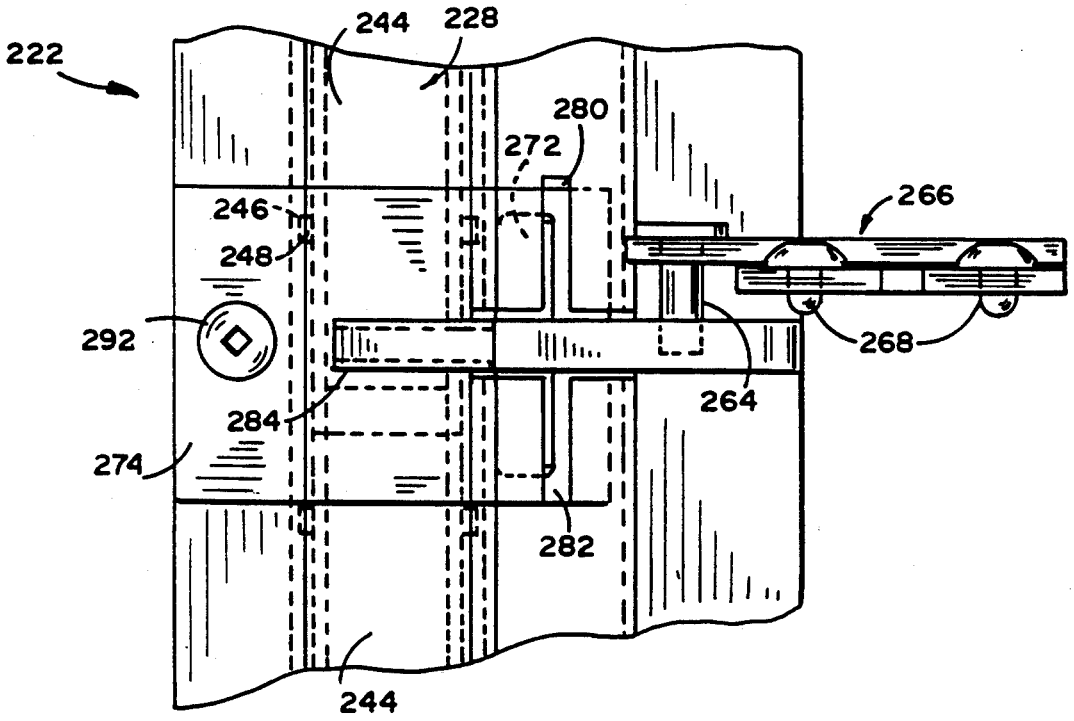
FIG. 21 is a fragmentary, front elevational view of the embodiment of FIG. 20.

An alternative embodiment of the present invention is illustrated in FIGS. 20 and 21 and designated by the numeral 210. Embodiment 210 is specifically configured for mounting at the rear center area of a cabinet. As shown, a center upright or channel 222 is fixed to an inner surface 224 of a rear wall 226 of a cabinet. Center upright 222 includes a main channel portion 228 defined by a base 230 and spaced, essentially parallel sides 232, 234. Center upright 222 further defines a reverse bent shoulder 236 joined to a flange extension 238. In the embodiment of FIGS. 20 and 21, a plurality of control or lock bars 244 are disposed within channel 228 for vertical sliding movement. Sides 232, 234 of channel 228 include spaced vertically extending slots 246. Each control bar 244 includes resilient ears 248 which extend into slots 246. Bars 244 may be snapped into the channel through the open front instead of being stacked from the top or bottom of the channel.

Mechanism 222 further includes a cam actuator 250. As seen in FIGS. 20 and 21, actuator 250 includes a control portion 252 defining a control slot 254 and a forward cam portion 256, as in the embodiment of FIG. 14. Legs 258, 260 which define control slot 254 are configured to receive an actuator control or pin 264. Pin 264 is retained by a bracket 266. Bracket 266 is attached to a bottom 270 of a cabinet drawer at the rear thereof by suitable fasteners 268.

Actuator 250 further includes an integral hinge or pivot pin 272. Due to space limitations at the rear of the cabinet, channel 228 is modified from the prior embodiment. It does not include the separate mounting channel and slots. As is clear from the drawings, a retainer plate or bracket 274 may be used to capture hinge pin 272 against flange extension 238 and the reverse bent shoulder 236. Extension 238 and shoulder 236 define an actuator channel. Extension 238 is formed with slots 280, 282. Retainer plate 274 defines a horizontally extending slot 284 dimensioned to receive actuator 250. In addition, plate 274 defines angled tabs 286 which are positioned through slots 280, 282. The bracket or retainer plate is then attached to the center upright 222 by a suitable fastener 292.

As in the prior embodiment, actuator 250 includes a resilient arm or finger 294. Finger 294 is illustrated as being formed integral with the main actuator body. Finger 294 acts as a spring to resiliently bias the cam actuator from a first or inoperative position illustrated in FIG. 20 to a second or operative position wherein cam portion 256 engages a follower surface of control bar 244 and is positioned between two adjacent bars. As shown, cam actuator 250 does not have the detents of the prior embodiment. In certain applications, finger 294 should be sufficient to hold the actuator in its second position.

Finger 294 could be a separate leaf spring member affixed to actuator 250. A separate spring element may be necessary to obtain the required spring force depending upon the material from which actuator 250 is constructed. In existing embodiments, actuator 250 is molded from a plastic, such as that sold under the name Delrin-500. The control or lock bars 244 are molded from a suitable plastic, such as Nylon 616. If less resilient, structural plastics were employed for the actuator, separate spring may be necessary. Also, a simple coil spring could be extended from a forward point 295 on actuator 250 to a side 297 of the vertical upright to bias the actuator to its second or operative position. Also, fastener 292 could be formed as an integral part of cam retainer plate 274. The fastener could be designed to merely snap into a corresponding aperture formed in center upright 222. With such an arrangement, the actuator cams 250 may be selectively positioned along the center upright or main channel without the use of tools, as in the prior embodiment.

In view of the foregoing description, those of ordinary skill in the art may envision various modifications to the present invention which would not depart from the patentable concepts disclosed. The above description should, therefore, be considered as only that of the preferred embodiment. The true spirit and scope of the present invention may be determined by reference to the appended claims.

The embodiments of the invention in which an exclusive property or privilege is claimed are defined as follows:

1. An interlock mechanism for use in a unit having a housing with an interior surface, at least two drawers and means for slidably mounting the drawers within the housing, said interlock mechanism comprising:

at least two control bars;

guide means defining a channel having closed ends for slidably supporting the control bars within the housing for vertical movement along the interior surface, adjacent control bars being movable from a contacting position to a spaced position;

at least two interlock cams, each cam defining an integral cam portion;

mounting means engaging said interlock cams for pivotally mounting said cams on the unit at selected positions adjacent said channel and without the use of tools for movement from a first inoperative position to a second, operative position in engagement with one of said control bars, said bars and said cam portions being dimensioned so that when one of said cams is in its second position, further movement of the bars is prevented and the remaining cams cannot move to their second positions, said mounting means defining a plurality of spaced slot, each slot dimensioned to removably receive one of said interlock cams;

at least two control members, each member operatively associated with one of the drawers so that movement of a drawer from a closed position towards an open position causes the control member to engage a respective one of said interlock cams so that further opening movement is possible only if such cam can move to its second position; and holding means on said cams for holding said cams in said second position, said holding means including resilient means for biasing said cams from said first position to said second position.

2. An interlock mechanism as defined by claim 1 further including:

lock means having a portion engagable with one of said control bars for preventing vertical movement of said lock bars and preventing movement of said interlock cams to their second positions.

3. An anti-tip interlock system for drawers, file cabinets and the like, said system comprising:

an elongated member defining a vertically extending guide track;

a plurality of elongated lock members disposed within said track in a vertically stacked relationship, each lock member defining lower and upper, angled, cam follower surfaces;

a plurality of actuators pivotally mounted for rotation about a vertical axis alongside said guide track for pivotal movement between a first, inoperative position and a second, operative position, each of said actuators including an integral cam portion and a vertically extending pivot pin, said elongated member including a plurality of vertically spaced, separate actuator receiving means for removably receiving said actuators so that said actuators may be selectively positioned along said elongated member without the use of tools and wherein said guide track, said lock members and said actuators are dimensioned so that one of said actuators may be pivoted from its first to its second position until the cam portion engages one of said follower surfaces causing a lock member to move vertically within the track preventing further vertical movement of the remaining lock members; and a plurality of control means operatively engaging said actuators for selectively moving said actuators between said first and second positions.

4. An anti-tip interlock system as defined by claim 3 wherein each of said actuators has a spring means for resiliently biasing said actuator from said first position to said second position.

5. An anti-tip interlock system as defined by claim 3 further including detent means on said actuator and said locking member for retaining said actuator in said second position in a positive, detent fashion.

6. An anti-tip interlock system as defined by claim 5 wherein said detent means comprises one of said actuator and said locking member defining a recess and the other of said actuator and said locking member defining a pin, said pin being disposed within said recess when said actuator is in said second position.

7. An anti-tip interlock system as defined by claim 6 wherein each of said actuators has a spring means for resiliently biasing said actuator from said first position to said second position.

8. An anti-tip interlock system as defined by claim 3 wherein said guide track in horizontal cross section includes a base, a first side generally perpendicular to said base and a second side which extends at an acute angle from said base towards said first side.

9. An anti-tip interlock system as defined by claim 8 wherein said lock members each include a front face and nonparallel sides, one side extending perpendicular to said face and the other side extending at an angle from said front face.

10. An anti-tip interlock system as defined by claim 3 wherein said actuators are each formed as one piece members, wherein each of said control means is a generally L-shaped bracket and wherein each actuator defines a slot for receiving said control means.

11. An anti-tip interlock system as defined by claim 3 further comprising:

a lock;

an elongated rod attached to said lock; and a lock member secured to said rod so that the rod may be shifted by the lock towards said channel and the lock member positioned to block movement of said control bars.

* * * * *

UNITED STATES PATENT AND TRADEMARK OFFICE

CERTIFICATE OF CORRECTION

PATENT NO. : 5,056,876

DATED : October 15, 1991

INVENTOR(S) : Douglas Scheerhorn

It is certified that error appears in the above-identified patent and that said Letters Patent is hereby corrected as shown below:

Column 1, line 9;

"filling" should be --filing--.

Column 7, line 37;

Before "separate" insert --a--.

Column 8, line 14;

"spaced slot" should be --spaced slots--.

Signed and Sealed this

Eleventh Day of May, 1993

*Attest:*

Michael K. Kirk

MICHAEL K. KIRK

*Attesting Officer*

*Acting Commissioner of Patents and Trademarks*